US008779998B1

(12) United States Patent
Pickles

(10) Patent No.: US 8,779,998 B1
(45) Date of Patent: Jul. 15, 2014

(54) WIDEBAND HORIZONTALLY POLARIZED OMNIDIRECTIONAL ANTENNA

(75) Inventor: William R. Pickles, Vienna, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 115 days.

(21) Appl. No.: 13/218,819

(22) Filed: Aug. 26, 2011

Related U.S. Application Data

(60) Provisional application No. 61/384,909, filed on Sep. 21, 2010.

(51) Int. Cl.
*H01Q 13/10* (2006.01)

(52) U.S. Cl.
USPC ..... 343/767; 343/770; 343/771; 343/891

(58) Field of Classification Search
None
See application file for complete search history.

(56) References Cited

U.S. PATENT DOCUMENTS 4,247,858 A * 1/1981 Eichweber ..... 343/729
4,590,480 A * 5/1986 Nikolayuk et al. ..... 343/771
4,763,130 A * 8/1988 Weinstein ..... 343/770
4,873,531 A * 10/1989 Heddebaut et al. ..... 343/711
5,717,410 A 2/1998 Ohmine et al.
6,429,819 B1 * 8/2002 Bishop et al. ..... 343/725
2002/0175862 A1 * 11/2002 Hunter et al. ..... 343/700 MS
2003/0043084 A1 * 3/2003 Egashira ..... 343/767
2004/0066345 A1 * 4/2004 Schadler ..... 343/767
2005/0146474 A1 * 7/2005 Bannon ..... 343/767
2005/0206573 A1 * 9/2005 Iigusa et al. ..... 343/770
2011/0215979 A1 * 9/2011 Lopez ..... 343/770
2011/0316734 A1 * 12/2011 Svensson ..... 342/175

OTHER PUBLICATIONS

A. Alford and R. M. Sprague, "A Four Slot Cylindrical Antenna for VOR Service", IRE International Convention Record, pp. 12-24 (1961).

* cited by examiner

*Primary Examiner* — Trinh Dinh
(74) *Attorney, Agent, or Firm* — US Naval Research Laboratory; L. George Legg

(57) ABSTRACT

A wideband horizontally polarized antenna includes a metallic antenna housing having four sides, a rectangular or hourglass slot in each side that is preferably offset from center, a square coaxial transmission or feed line positioned along a central axis of the metallic antenna housing, and a metal tab connecting each of the slots to the feed line. The antenna operates over a wide bandwidth and has a small profile.

6 Claims, 17 Drawing Sheets

WIDEBAND HORIZONTALLY POLARIZED OMNIDIRECTIONAL ANTENNA

CROSS-REFERENCE TO RELATED APPLICATIONS

This Application claims the benefit of U.S. Provisional Application 61/384,909 filed on Sep. 21, 2010 and incorporated herein by reference.

FIELD OF THE INVENTION

The invention is directed to an omnidirectional antenna, and more particularly, to a wideband, horizontally polarized, omnidirectional antenna.

BACKGROUND OF THE INVENTION

The classic omni-directional antenna is a vertically oriented half wavelength dipole as shown in FIG. 1. It produces a radiation pattern which has no variation in azimuth and an elevation pattern which is 78 degrees wide. Half wavelength dipoles typically have a bandwidth of 10 percent or less. In practice most omni-directional antennas have some azimuthal variation as shown in FIG. 2. This variation can be caused by the proximity of the a structure the antenna is mounted on, or asymmetries in the antenna.

According to standard 2.257 in the IEEE standards dictionary an omnidirectional antenna is defined as "An antenna having an essentially non-directional pattern in a given plane." The IEEE standard does not specify how much variation an antenna pattern can exhibit and still be called omnidirectional.

Conical dipoles as shown in FIG. 3, wherein the arms of the dipole are cones have perfect omni-directional patterns and can achieve bandwidths of a couple octaves. Printed circuit versions of dipoles and bicones incur some ripple in their azimuth patterns because they do not have rotational symmetry. The printed circuit version of the bicone antenna is called a bowtie antenna and is shown in FIG. 4.

The omni-directional antennas discussed above are vertically polarized. Horizontally polarized omni-directional antennas are less frequently employed. A common horizontally polarized antenna is a vertically oriented slot. Slots require a larger metallic structure to exist within such as a ground plane or a waveguide. Slots also require an external excitation such as a waveguide or a circuit that couples to the slot. Slots are rather narrow band—on the order of a few percent—and slots tend to have high impedances relative to the 50 ohm circuitry that is common used in microwave circuitry.

A simple slot antenna is the Alford slot antenna. It consists of a single thin longitudinal slot in a narrow cylinder as shown in FIG. 5. The Alford slot antenna has an omni directional horizontally polarized pattern when the diameter of the cylinder is less than ⅛ of a wavelength. When the diameter of the cylinder is greater than ¼ wavelength, the Alford slot has a directional pattern. The Alford slot shown in FIG. 5 has a diameter of ⅛ wavelength and a slot length of about ¾ wavelength. The ⅛ wavelength tube is so small that waveguide modes are completely cut-off inside the tube. However the tube loads the mode which exists in the slot, which accounts for the resonant length which is considerably longer than a half wavelength. The Alford slot shown in FIG. 5 is fed by a balanced high impedance transmission line. In practical usage, a balun would be required to convert the input to an unbalanced 50 ohm transmission line.

A numerical analysis by this writer showed that the Alford has about 2 dB variation in its azimuth pattern as shown in FIG. 6A. The bandwidth can be calculated from the notations on the Smith chart: 2*(3.0 Ghz−2.94 Ghz)/(3.0 Ghz+2.94 Ghz)=2 percent. If the impedance contour in FIG. 6B can be made to enclose the origin, the bandwidth can be increased. However it was difficult to make numerical simulations of the Alford slot converge, indicating that it is sensitive to small dimensional variations. The impedance contour in FIG. 6B is transformed from the port at the bottom of the antenna to the slot. The impedance contour resides mostly in the upper half of the Smith Chart indicating that the slot is inductive. The inductive nature of slots will be noted later in describing the operation of the antenna according to this invention. It will employ added capacitance to cancel the inductance of slots.

The slotted waveguide antenna shown in FIG. 7 has identical slots cut in the broadwalls which are adjacent to each other, parallel to the center line of the waveguide, and offset from the respective centers of the faces they reside in. Each slot radiates a somewhat directional pattern in opposite directions.

As noted above, slots are fairly high impedance radiators. Waveguide impedance increases with the width of the narrow walls. This leads to a trade-off with the slotted waveguide antenna. When the narrow walls are narrow, the patterns are better, but the impedance match is poor. When the narrow walls are wide, the impedance match is better but more ripple develops in the patterns. The radiation pattern of the slotted waveguide antenna shown in FIG. 7 are shown in FIG. 8. Note that the slotted waveguide antenna patterns have 1.5 dB ripple which is less than the Alford loop antenna. The waveguide shown in FIG. 7 is approximately one quarter height. If it were half height waveguide, the patterns would have about 4 dB ripple. The antenna according to this invention has less ripple.

Some improvements in the slotted waveguide omni antenna can be obtained by placing a coaxial feed network inside the waveguide as shown in FIG. 9. This alleviates difficulty of obtaining a good match with a thin guide. The impedance of the coaxial feed can be increased to improve the match even in thin waveguide. This may decrease the power handling capacity of the antenna. According to Ohmine, the slots should be centered to obtain omni directional radiation patterns.

The results of a simulation of Ohmine's antenna is shown in FIGS. 10A-B. FIG. 10A shows the impedance plot (showing only the band of frequencies for which the reflection is less than −10 dB) for Ohmine's coaxially fed slotted waveguide antenna, and FIG. 10B shows the corresponding simulated Azimuthal radiation patterns. This indicates the slotted waveguide antenna with coaxial feed has about 0.9 dB pattern ripple which is less than the waveguide fed slotted waveguide antenna. The patterns are better than those given by Ohmine, who indicates about 2 Db ripple in the horizontal polarization, and vertical polarization which is about 25 dB below the horizontal. This could occur if Ohmine used larger waveguide (scaled to the wavelength of the radiation). The bandwidth of the coaxial fed slotted waveguide can be calculated from the notations on the Smith chart in FIG. 10(*b*): 2*(3.03 GHz.−2.88 GHz.)/(3.03 GHz.+2.88 GAZ.)=5 percent. This is inferior to the waveguide fed slotted waveguide antenna. The rectangular tube can be reduced in size below the cut-off limit imposed by a waveguide feed as shown in FIG. 11. However, as the tube gets smaller, the resonant length of the slot gets longer Apparently the Ohmine antenna with a smallish tube behaves somewhat like the Alford slot antenna.

BRIEF SUMMARY OF THE INVENTION

According to the invention, a wideband horizontally polarized antenna includes a metallic antenna housing having four sides, a rectangular or hourglass slot preferably with an offset (i.e. non-centered) location in each side and, a square coaxial transmission or feed line positioned along a central axis of the metallic antenna housing, and a metal tab connecting each of the slots to the feed line.

The antenna according to this invention has a horizontally polarized radiation pattern like that shown in FIG. 2. However the azimuthal variations are small. The antenna according to this invention generates a horizontally polarized radiation which is omnidirectional in the azimuth plane, and has a bandwidth greater than 30 percent. The profile of the antenna is small so it will have low wind loading. There are other horizontally polarized antennas with comparable profiles, but which have bandwidths of only 10 percent or less. Although there exist horizontally polarized omnidirectional radiators with wider bandwidths, they also have a larger profile. The antenna of the invention is desirable for the wide bandwidth it operates over with such a small profile.

DETAILED DESCRIPTION OF THE INVENTION

Figure 1:
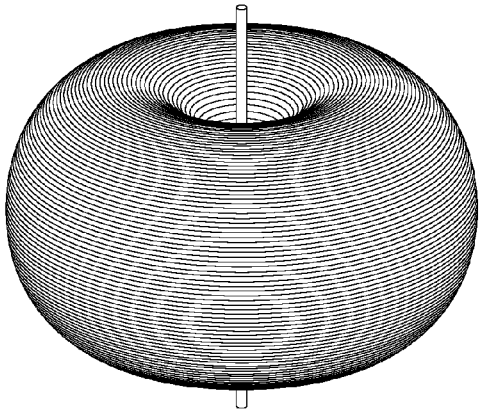
FIG. 1 PRIOR ART
FIG. 1 is a vertically oriented half wavelength dipole radiation pattern of a prior art omni-directional antenna.
Figure 2:
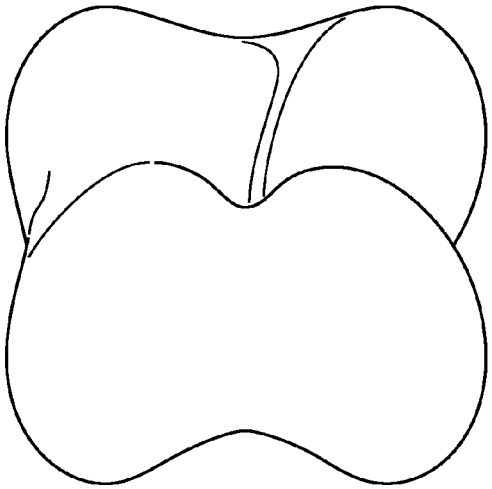
FIG. 2 PRIOR ART
FIG. 2 is a radiation pattern showing the azimuthal variation of a prior art omni-directional antenna.
Figure 3:
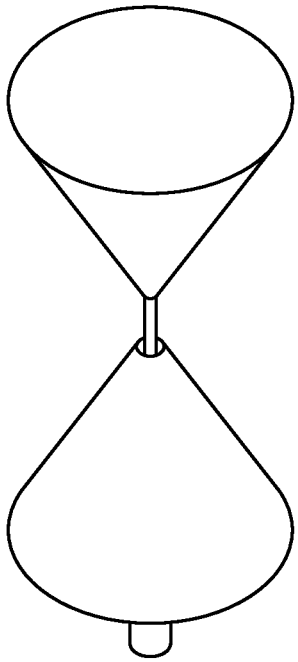
FIG. 3 PRIOR ART
FIG. 3 is a prior art antenna conical dipole radiation pattern.
Figure 4:
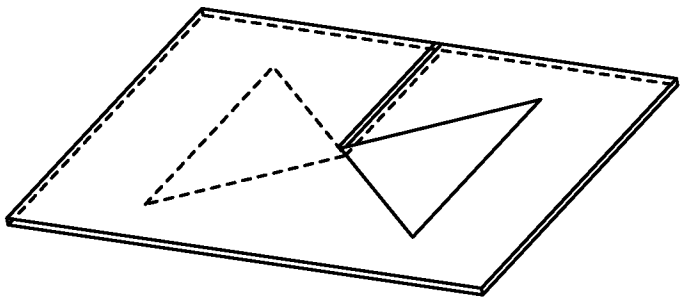
FIG. 4 PRIOR ART
FIG. 4 is a printed circuit version of a prior art bicone antenna.
Figure 5:
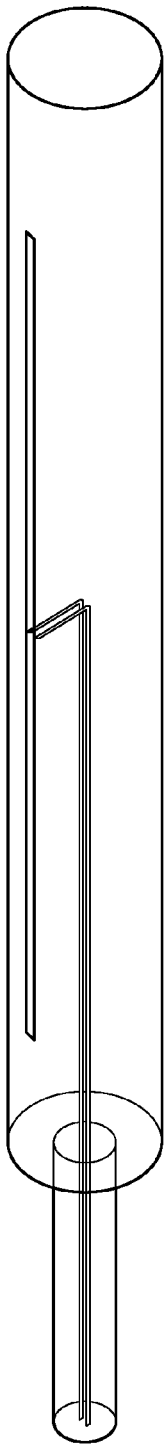
FIG. 5 PRIOR ART
FIG. 5 is a prior art Alford slot antenna.
Figure 6A:
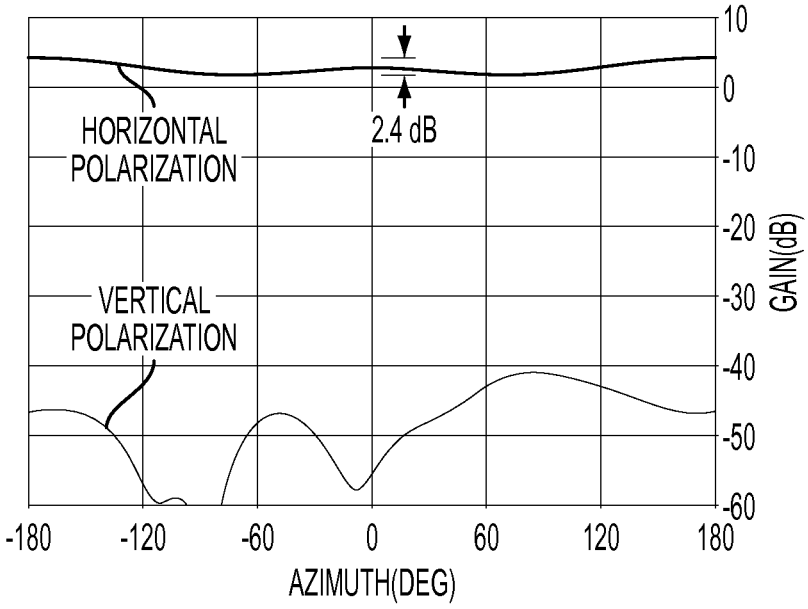
FIG. 6A PRIOR ART
FIGS. 6A-B show the azimuth pattern of the antenna of FIG. 5.
Figure 6B:
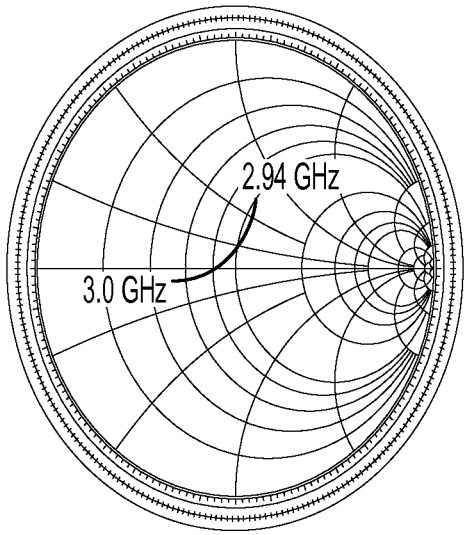
FIG. 6B PRIOR ART
Figure 7:
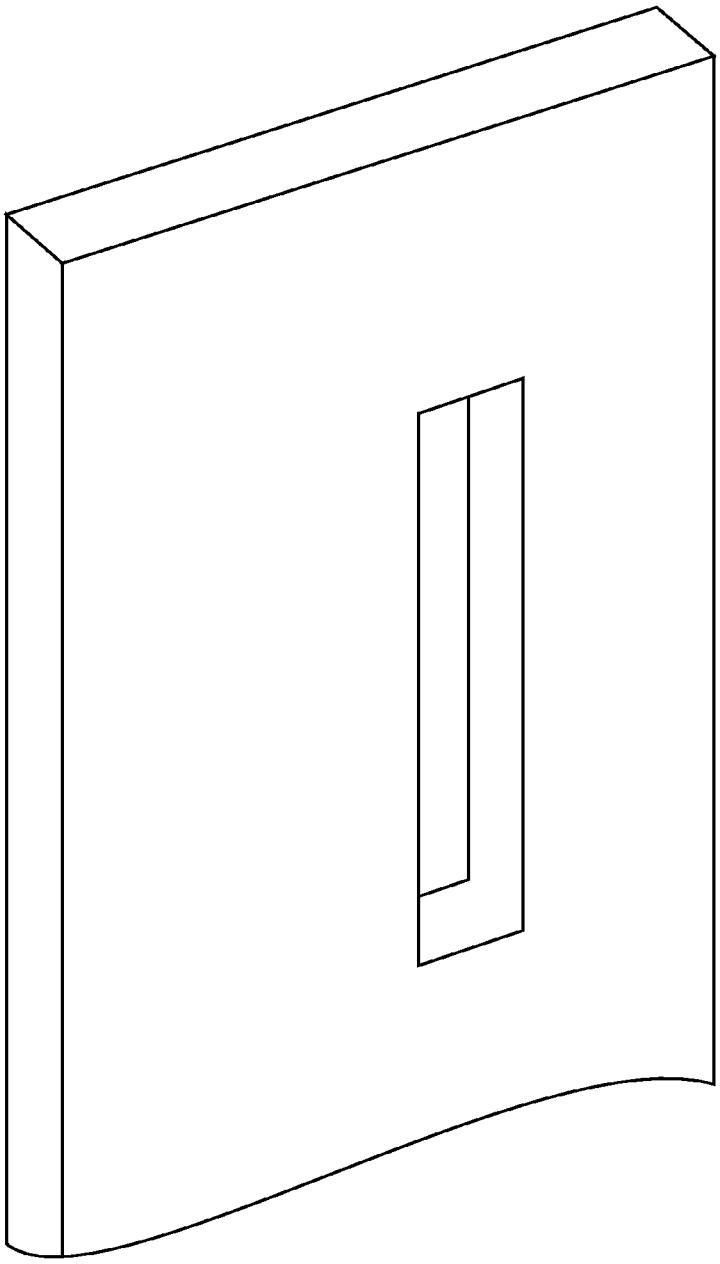
FIG. 7 PRIOR ART
FIG. 7 is a prior art slotted waveguide antenna.
Figure 8:
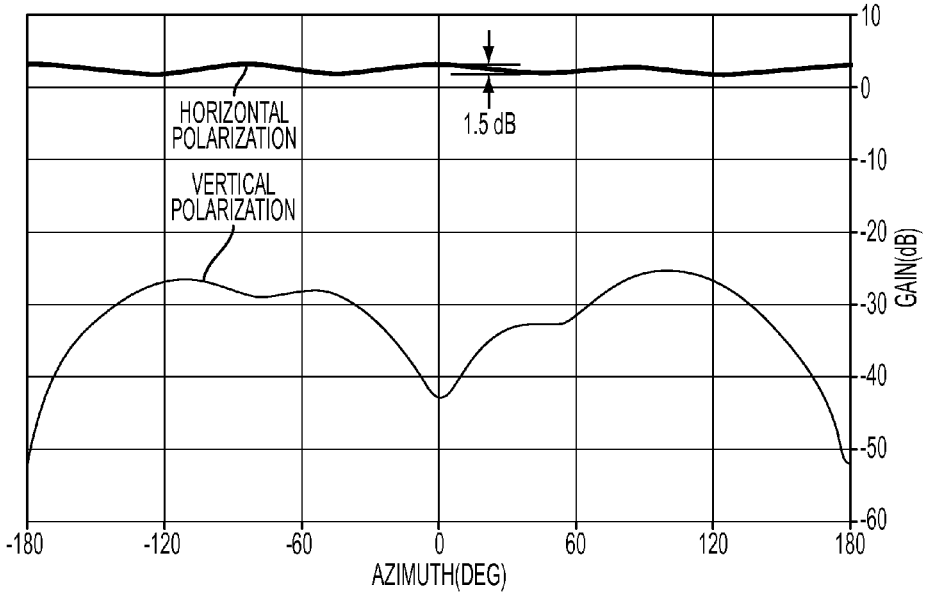
FIG. 8 PRIOR ART
FIG. 8 is the radiation pattern of the slotted waveguide antenna of FIG. 7.
Figure 9:
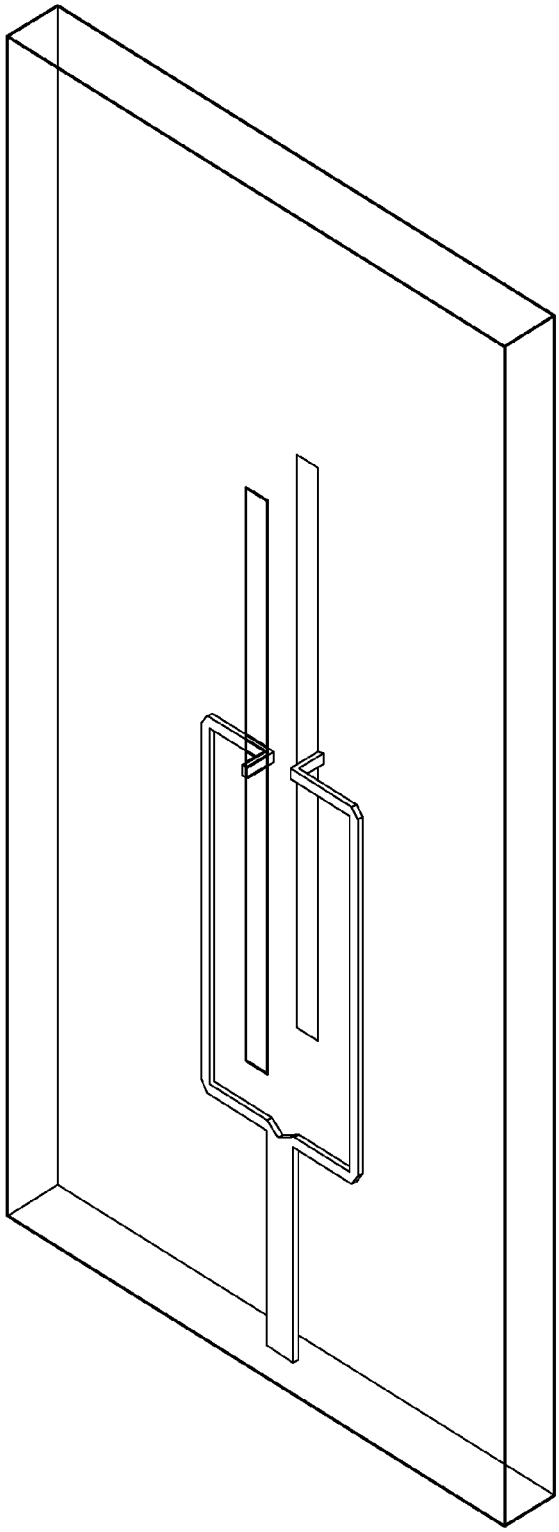
FIG. 9 PRIOR ART
FIG. 9 is a prior art slotted waveguide omni antenna with a coaxial feed network.
Figure 10A:
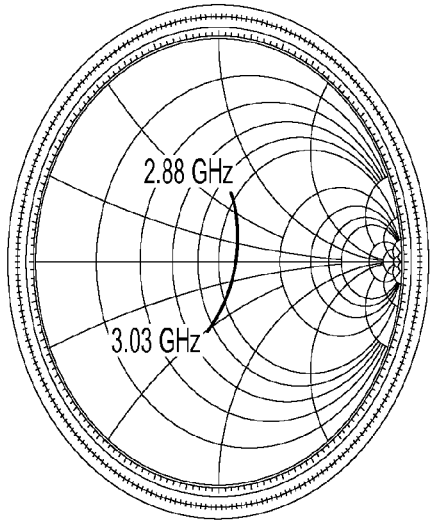
FIG. 10A PRIOR ART
FIGS. 10A-B respectively are the simulated impedance plot and radiation pattern for a prior art Ohmine's coaxially fed slotted waveguide antenna.
Figure 10B:
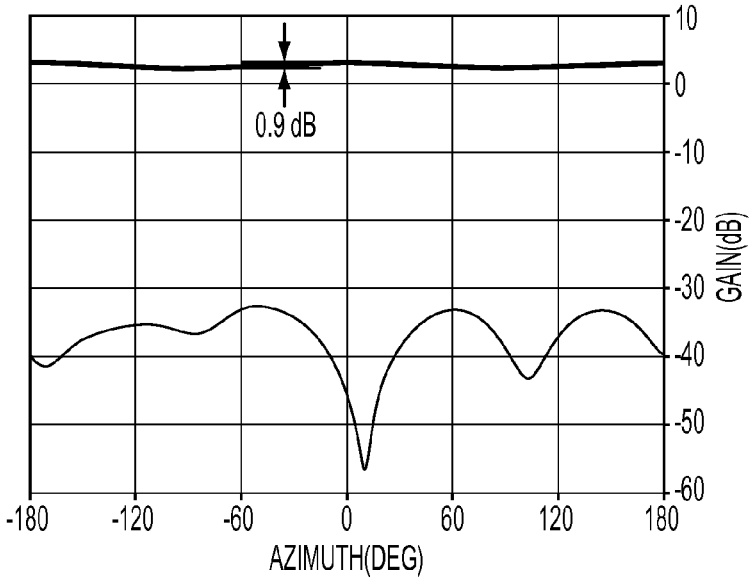
FIG. 10B PRIOR ART
Figure 11:
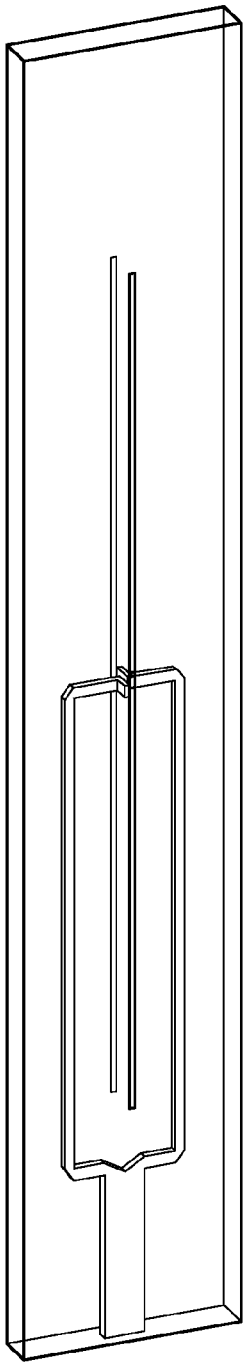
FIG. 11 PRIOR ART
FIG. 11 is a prior art coaxially fed slotted waveguide antenna with the rectangular tube reduced in size below the cut-off limit imposed by a waveguide feed.
Figure 12:
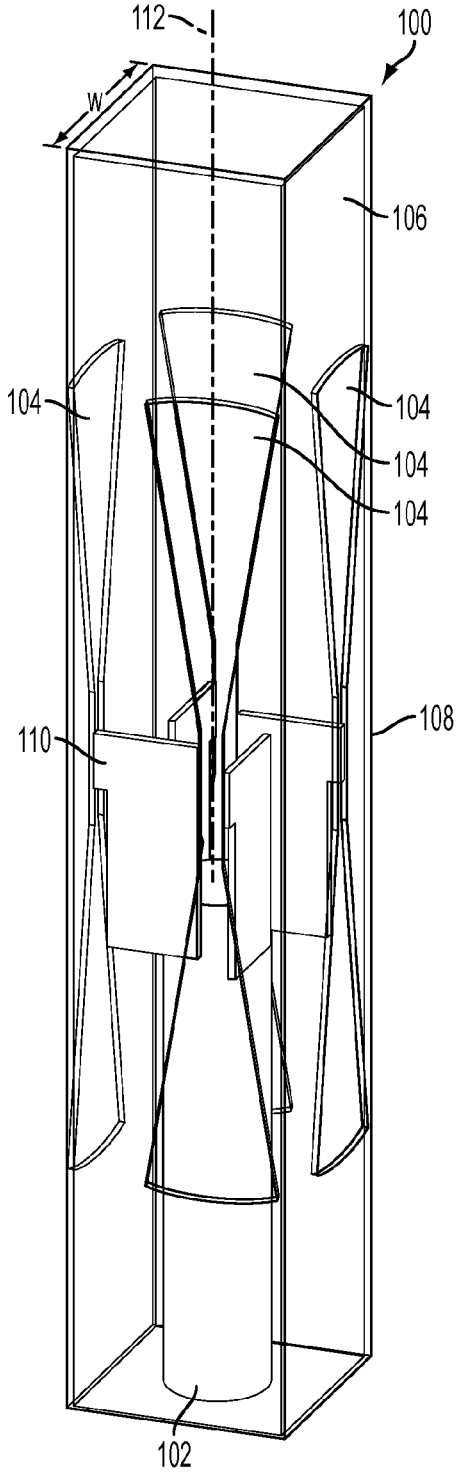
FIG. 12 is a perspective view of an antenna with offset hourglass shaped slots with interior detail shown partially in phantom according to the invention.

Referring now to FIG. 12, an antenna 100 according to the invention consists of a square coaxial transmission or feed line 102 with an hourglass shaped slot 104 cut in each of the four walls 106 of an antenna housing 108. As used herein, the term "hourglass" broadly includes a slot with each of its end-widths greater than its midpoint width. The four hourglass slots 104 are substantially identical to one another, and are preferably offset from the centers of the faces they reside in. This offset improves the polarization purity of the antenna 100. Each slot 104 is preferably about 1 wavelength long at midband and connected to its feed line 102 by a metal tab 110 which adds capacitance to the antenna 100 so as to improve the impedance match of the antenna. The slots 104 are excited on only one side, so the opposite side of each slot is floating. A horizontally polarized electric field is established in the slot 104 between the metal tab 110 from the feed line 102, and the floating side of the slot. The electric field travels away from the center of the slot to the ends, and radiates a horizontally polarized field as it does so. As shown, feed line 102 is positioned along a central axis 112 of housing 108. The width w of housing 108 is preferably about 0.3 wavelength at midband, which with the appropriate selection of the spacing between the top of the housing 108 and the top of slots 104 (and 202, 302) minimizes beam squint.

Figure 13A:
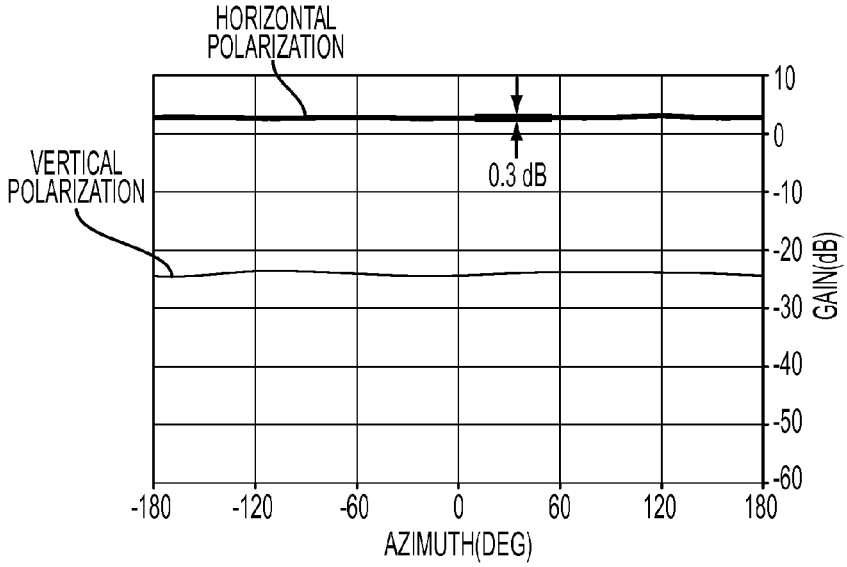
FIGS. 13A-B respectively are the simulated impedance plot and radiation pattern of the antenna of FIG. 12 according to the invention.
Figure 13B:
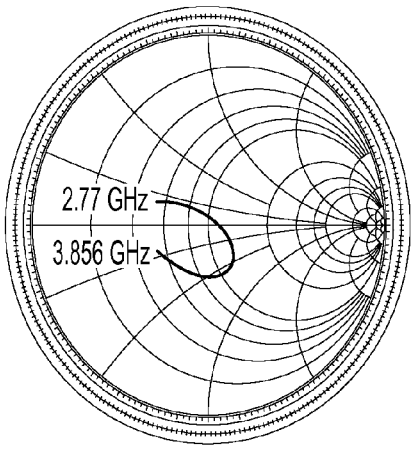

Simulated radiation patterns and impedance plot of antenna 100 are respectively shown in FIGS. 13A-B. The radiation patterns of the slots are somewhat directional but broad enough so that they overlap, creating a substantially omnidirectional, horizontally polarized outward traveling wave. FIG. 13A shows the simulated radiation patterns. It exhibits a ripple of 0.3 dB in the horizontally polarized pattern which is very good. The cross polarized, or vertically polarized wave generated by this antenna is about 27 dB below the co- or horizontally polarized field. This is probably good enough for most applications. The bandwidth of the antenna according to this invention can be determined from the annotations on the Smith chart: 2*(3.856 Gaz.−2.77 Gaz.)/(3.856 Gaz.+2.77 Gaz.)=32.8 percent. This is very good.

Figure 14:
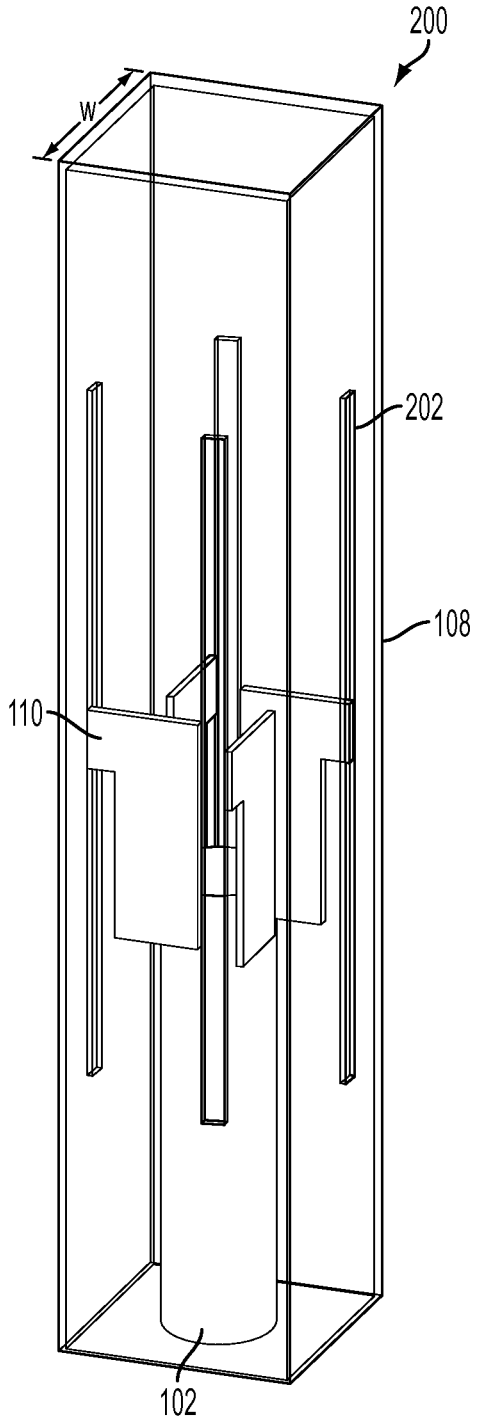
FIG. 14 is a perspective view of an antenna with straight or rectangular slots with interior detail shown partially in phantom according to the invention.
Figure 15A:
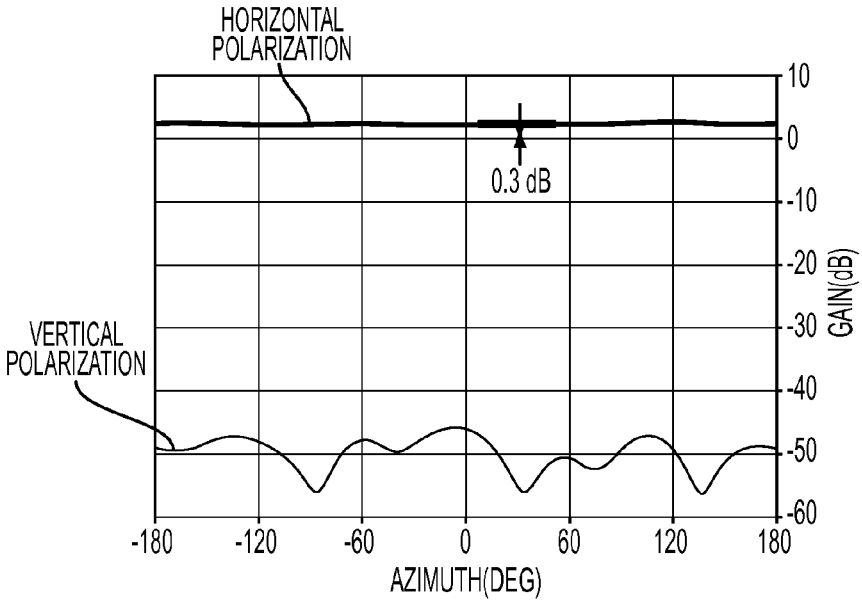
FIGS. 15A-B respectively are the simulated impedance plot and radiation pattern of the antenna of FIG. 14 according to the invention.
Figure 15B:
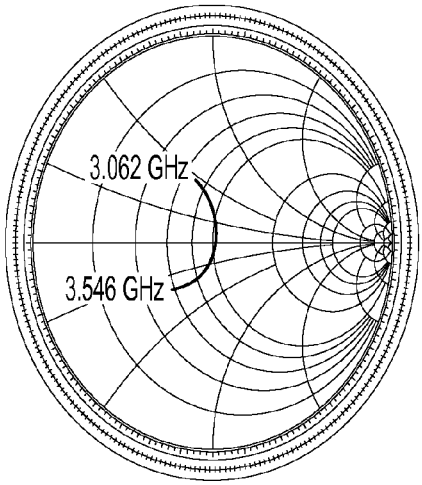

FIG. 14 shows antenna 200 according to the invention that, in lieu of the hourglass-shaped slots 104 of antenna 100, has straight or rectangular slots 202 each of which is preferably about % wavelength long at midband. The advantage of this configuration is that it generates a horizontally polarized omnidirectional antenna pattern with enhanced polarization purity. However this comes at the expense of bandwidth. Antenna 100 has a bandwidth of 32.8 percent and a polarization purity of 27 dB. As shown in FIG. 15A, the vertically polarized radiation produced by antenna 200 is 50 dB below the horizontally polarized radiation level. The bandwidth of antenna 200 can be determined from the Smith Chart in FIG. 15B. It shows the range of frequencies for which the input reflection is less than −10 dB. Reading the annotations off the Smith chart, one arrives at 2*(3.546 Gaz.−3.062 Gaz.)/(3.546 Gaz.+3.062 Gaz.)=14.6 percent.

Figure 16:
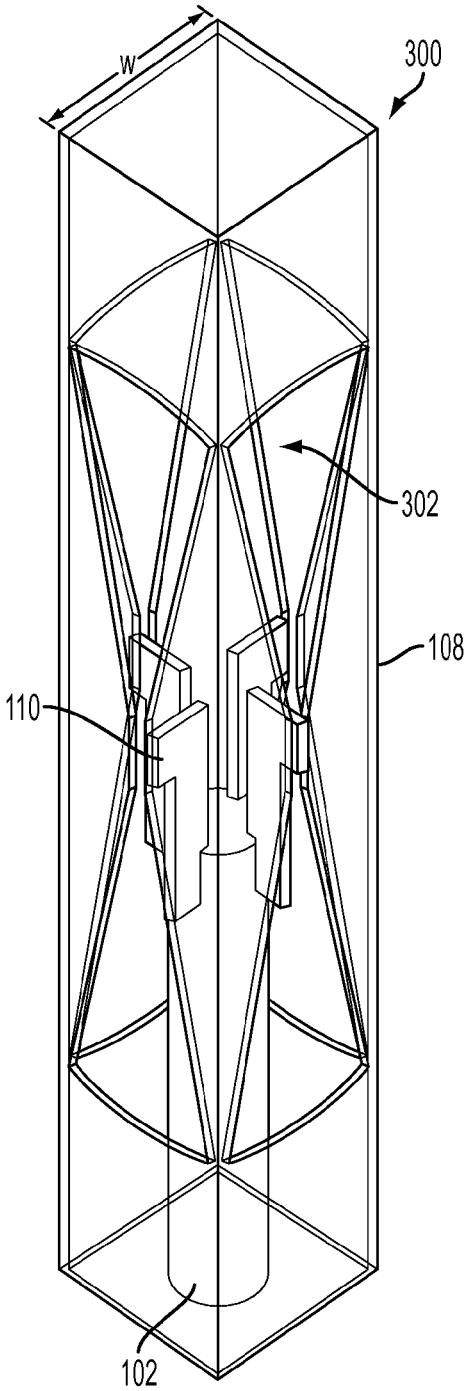
FIG. 16 is a perspective view of an antenna with centered hourglass shaped slots with interior detail shown partially in phantom according to the invention.
Figure 17A:
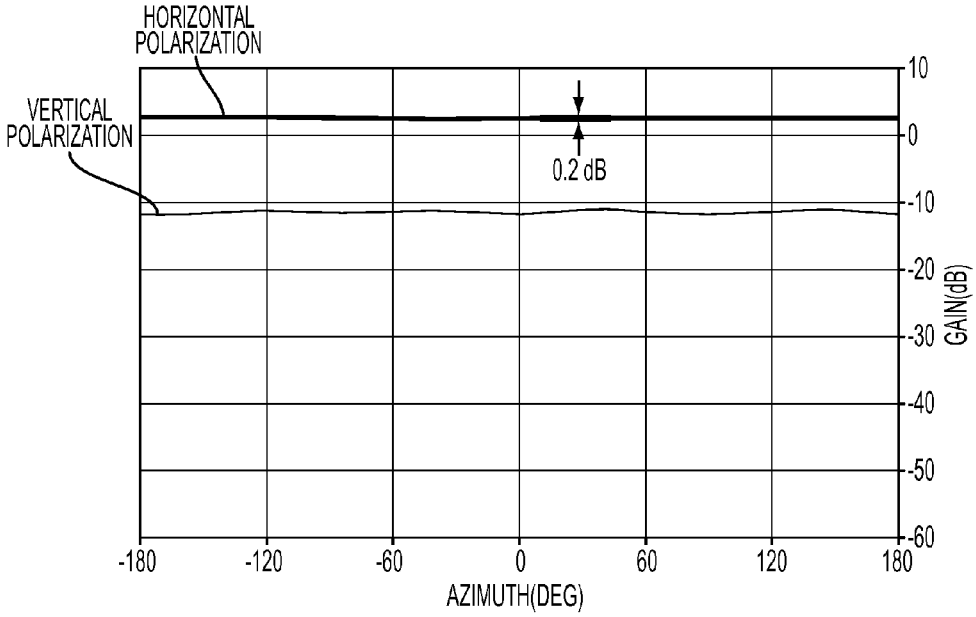
FIGS. 17A-B respectively are the simulated impedance plot and radiation pattern of the antenna of FIG. 16 according to the invention.
Figure 17B:
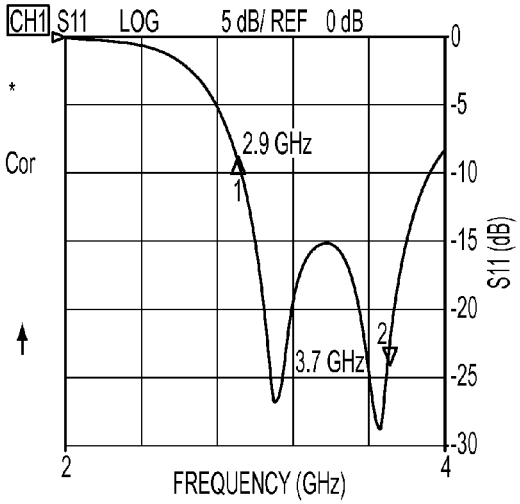

FIG. 16 shows another embodiment of the invention. Antenna 300 has hourglass shaped slots 302 which are centered rather than offset as in antenna 100. The radiation patterns and impedance measurements (i.e. not electromagnetic simulations) of this embodiment are shown in FIGS. 17A-B. The horizontally polarized radiation patterns in FIGS. 13 and 17 are similar—they exhibit almost the same low ripple. The vertically polarized radiation patterns are different. The centered slot antenna in FIG. 16 has vertically polarized (undesirable) radiation levels which are 11 to 12 dB higher than the offset slot antenna in FIG. 12.

Obviously many modifications and variations of the present invention are possible in the light of the above teachings. It is therefore to be understood that the scope of the invention should be determined by referring to the following appended claims.

What is claimed as new and desired to be protected by Letters Patent of the United States is:

1. A wideband horizontally polarized antenna, comprising:

a metallic antenna housing having four sides;

only one hourglass-shaped slot positioned in each side of said four sides, wherein each said slot is one wavelength long at a center frequency of a selected operating frequency band, each said slot has a first side, a second opposing side, and two ends, and wherein each said side of said four sides of said metallic antenna housing has a face and a center of said face;

a coaxial transmission or feed line positioned along a central axis of the metallic antenna housing; and a metal tab connecting each of said first side of each said slot to the feed line, whereby when the antenna is powered up each of said slots is excited only on each said first side with each said second opposing side floating, thereby establishing a horizontally polarized electric field in each said slot between each metal tab from the feed line and each floating side such that an electric field travels away from the center of each said slot to the ends and radiates a horizontally polarized field.

2. The antenna of claim 1, wherein each said slot is offset from the center of the face of the side in which each said slot is positioned.

3. The antenna of claim 1, wherein each said slot is positioned at the center of the face of the side in which each said slot is positioned.

4. A wideband horizontally polarized antenna, comprising:

a metallic antenna housing having four sides;

only one rectangular-shaped slot positioned in each side of said four sides, wherein each said slot is one wavelength long at a center frequency of a selected operating frequency band, each said slot has a first side, a second opposing side, and two ends, and wherein each said side of said four sides of said metallic antenna housing has a face and a center of said face;

a coaxial transmission or feed line positioned along a central axis of the metallic antenna housing; and a metal tab connecting each of said first side of each said slot to the feed line, whereby when the antenna is powered up each of said slots is excited only on each said first side with each said second opposing side floating, thereby establishing a horizontally polarized electric field in each said slot between each metal tab from the feed line and each floating side such that an electric field travels away from the center of each said slot to the ends and radiates a horizontally polarized field.

5. The antenna of claim 4, wherein each said slot is offset from the center of the face of the side in which each said slot is positioned.

6. The antenna of claim 4, wherein each said slot is positioned at the center of the face of the side in which each said slot is positioned.

* * * * *